US005372202A

United States Patent [19]

Dallas

[11] Patent Number: 5,372,202

[45] Date of Patent: Dec. 13, 1994

[54] WELLHEAD ISOLATION TOOL AND METHOD OF USE

[76] Inventor: Murray Dallas, 801 New England Ct., Allen, Tex. 75002

[21] Appl. No.: 160,477

[22] Filed: Dec. 1, 1993

Related U.S. Application Data

[63] Continuation-in-part of Ser. No. 958,502, Oct. 8, 1992, Pat. No. 5,332,044.

[51] Int. Cl.[5] ..... E21B 33/00

[52] U.S. Cl. ..... 166/386; 166/86

[58] Field of Search ..... 166/386, 387, 381, 86–88

[56] References Cited

U.S. PATENT DOCUMENTS

| | | | |
|---|---|---|---|
| 2,009,888 | 7/1935 | Hild | 166/86 |
| 3,731,742 | 5/1973 | Sizer et al. | 166/386 X |
| 4,427,060 | 1/1984 | Villers, Sr. | 166/386 X |
| 4,646,844 | 3/1987 | Roche et al. | 166/86 X |

*Primary Examiner*—Michael Powell Buiz

*Attorney, Agent, or Firm*—Varnum, Riddering, Schmidt & Howlett

[57] ABSTRACT

A wellhead isolation tool is disclosed that is unique because the tool has no direct connection between the high pressure valve and the mandrel. Well stimulation fluids are pumped through one or more high pressure bores which communicate with a mandrel injection head that directs the fluids into the mandrel. The injection head and the mandrel are enclosed in a sealed bore and reciprocatably movable with a piston which is used to stroke the mandrel into and out of a wellhead and to lock the mandrel in an operating position wherein ports in the injection head are aligned with the high pressure bores. The piston may be reciprocated using a mechanical screw. A concentric mandrel embodiment providing a pack-off nipple expander is also disclosed. The tool provides superior safety features and ease of operation.

15 Claims, 8 Drawing Sheets

WELLHEAD ISOLATION TOOL AND METHOD OF USE

RELATED APPLICATIONS

This application is a continuation in part of U.S. patent application Ser. No. 07/958,502 which was filed on Oct. 8, 1992, U.S. Pat. No. 5,332,044.

FIELD OF THE INVENTION

The present invention relates to wellhead equipment, and in particular to a wellhead isolation tool useful in isolating wellhead equipment from the extreme pressures, abrasive and/or caustic substances used in well stimulation treatments.

BACKGROUND OF THE INVENTION

Oil and gas wells frequently require stimulation in order to recommence or improve a flow of hydrocarbon from the hydrocarbon bearing formation with which a well bore communicates. Well stimulation generally involves the pumping of fluid mixtures into the hydrocarbon formation at extreme pressures. The fluid mixtures frequently comprise acid solutions and/or abrasive proppants such as bauxite granules or sand. Wellheads generally comprise one or more valves, a casing spool, tubing spool, tubing hanger, blowout preventer, and related apparatus which is designed to contain and control well fluids at well pressures. Wellheads are not usually designed to withstand the abrasive effects of well stimulation proppants or the extreme pressures of well stimulation treatments. It is therefore necessary to provide a tool for isolating the wellhead from the caustic and/or abrasive fluids as well as the extreme fluid pressures used in well stimulation treatments. Many wellhead isolation tools have been invented for satisfying this requirement. The prior art considered most relevant to the present invention includes:

Canadian Patent 1,137,869—Surjaamadja
Canadian Patent Application 1,277,230—McLeod
Canadian Patent Application 1,281,280—McLeod
Canadian Patent Application 1,292,675—McLeod
Canadian Patent Application 2,055,656—McLeod Wellhead isolation tools are alike in that each tool inserts a length of high pressure tubing, hereinafter referred to as a mandrel, through a vertical passage defined by the wellhead, the lower end of the tubing being sealed or packed off in the production robing or casing of the well. Each tool also requires a mechanism to prevent well bore gases from escaping to atmosphere while stroking the mandrel into our out of the wellhead. Each also requires a high pressure valve, traditionally connected to a top of the mandrel, to control pressure while the mandrel is seated and packed off in the well tubing or casing.

Well stimulation treatment is a potentially dangerous operation because of the extreme pressures used to inject fluid mixtures into a well bore. It is therefore desirable to provide a wellhead isolation tool which permits ready and easy access to the injection lines used for well stimulation. It is also desirable to provide a tool which locates the hook-up point for the injection lines as close to the wellhead as possible in order to minimize the stress of the racking forces sometimes exerted by fluid pressures in the injection lines. It also desirable to provide a wellhead isolation tool which can be extracted from the wellhead trader any condition, including "screen out" in which a blockage occurs or the well's capacity for accepting abrasive proppants is exceeded and the entire apparatus, including the wellhead isolation tool, is packed with abrasives injected under extreme pressure. In addition, it is preferable to provide a wellhead isolation tool having a mandrel that is completely enclosed in a sealed bore. This feature is desirable for two reasons. First, an exposed stuffing box can leak or fail and discharge hydrocarbons to the atmosphere when a mandrel is being stroked in or out of a wellhead. Second, if large quantities of coarse abrasive are pumped in one session, the abrasives can wear a hole through the sidewall of a mandrel. If this occurs, an exposed mandrel cannot be safely stroked out of the well.

In a first generation of prior art wellhead isolation tools the high pressure valves used to control well stimulation fluid pressures are located too high above the wellhead and are therefore difficult to access. These first generation tools were also arranged so the apparatus used to stroke a mandrel through a wellhead was left on the wellhead during well stimulation treatments. This places strain on the wellhead and subjects the wellhead to excessive racking forces if "line jack" occurs during a stimulation treatment. "Line jack" is a high speed vibration or whipping of stimulation lines which occurs if a blockage develops while pumping slurries high in sand content or when a hydraulic valve malfunctions.

In a second generation of wellhead isolation tools, apparatus used to stroke the mandrel through a wellhead was designed to be removed from the wellhead during a stimulation treatment so that the high pressure valve was located in closer proximity to the wellhead, thereby making the valve more readily accessible and minimizing the racking forces exerted by line jack. The disadvantage of the second generation tools is that they require that a portion of the tool be disassembled after the mandrel is stroked through the wellhead and reassembled before the mandrel can be stroked out of the wellhead. In the event of a blow-out or a fire during a stimulation treatment, it may be difficult or impossible to reassemble the tool in order to stroke out the mandrel so that the main control valve or a blow out preventer in the wellhead can be closed to bring the situation under control.

The known wellhead isolation tools fall to provide all of the desirable features required to minimize the hazards of well stimulation and maximize the ease and speed of preparing a well for stimulation treatment.

SUMMARY OF THE INVENTION

It is a primary object of the invention to provide a wellhead isolation tool which is more convenient to use and safer to operate than wellhead isolation tools known in the prior art.

The present invention also achieves a plurality of further objects which include:

- a wellhead isolation tool having a mandrel that can be stroked in and stroked out of the wellhead without closing the high pressure valve of the tool;
- a wellhead isolation tool that is hydraulically locked in place without mechanical contrivances of any kind, thus enabling the mandrel to be stroked in or out of the wellhead by using a hydraulic valve which is located a safe distance from the wellhead;
- a wellhead isolation tool which permits the mandrel to be stroked out of the wellhead with a well stimulation line connected to a high pressure valve in an instance of a high pressure valve failure or an instance of severe screen out when abrasives block the gate of the high pressure valve so that the valve cannot be properly closed;

a wellhead isolation tool which permits the well stimulation line(s) to be left connected to the high pressure valve while the mandrel is stroked out of the wellhead in an instance of a fire, blow-out or similar emergency;

a wellhead isolation tool which has no exposed packing that could permit blow-by or blow-out while stroking the mandrel into or out of the wellhead;

a wellhead isolation tool having a mandrel which can be stroked out of the wellhead under any condition regardless of whether the well exerts high natural pressure or no pressure at all;

a wellhead isolation tool which may be operated using wellhead pressure to stroke in or stroke out the mandrel, thus eliminating a requirement for a hydraulic system in remote or inaccessible areas; and, a wellhead isolation tool having a mandrel which can be stroked out of the wellhead as soon as the injection pumps are stopped, permitting a blow-out preventer valve to be closed almost immediately in the event of a fire at the wellhead, thereby containing the well without serious consequences and without endangering personnel.

In accordance with the present invention there is provided a wellhead isolation tool to permit the injection of fluids, solid particles and mixtures thereof into a wellhead having a sealed bore therethrough and including at least one valve and into a well having a production robing or a well casing aligned with the sealed bore, the tool comprising:

means for attaching the tool to the wellhead;

a pressure relief valve located adjacent the means for attaching the tool to the wellhead;

a high pressure valve located above the pressure relief valve;

a hollow cylinder located above the high pressure valve, the cylinder having a piston forcibly reciprocatable therein;

a mandrel reciprocatable with the piston in a sealed bore defined by the tool, the mandrel including an axial bore and an injection port which communicates with the axial bore so that the injection port aligns with a bore selectively closed by the high pressure valve when the mandrel is extended through the wellhead and a pack-off nipple attached to a bottom end of the mandrel sealingly engages the production tubing or the casing; and packing means for engaging a periphery of the mandrel in a fluid-tight seal which permits reciprocal movement of the mandrel, the packing means being located in the sealed bore between the pressure relief valve and the high pressure valve.

The invention therefore provides a wellhead isolation tool which is compact, requires no disassembly after a mandrel is inserted into the wellhead and permits the mandrel to be extracted from the wellhead at any time without disconnecting the well stimulation lines, closing the high pressure valves, or otherwise changing the disposition of the tool. This provides a great deal of flexibility in operating the tool and minimizes the effort required to prepare a wellhead for a well stimulation treatment.

In accordance with a further aspect of the invention, there is advantageously provided a pull rod which extends through a top end the hollow cylinder used to stroke the mandrel into and out of the wellhead. The pull rod serves the function of a positive indicator to graphically illustrate the position of the mandrel in the wellhead at any given time. In addition, the pull rod provides a means for extracting the mandrel if the well is "killed" during a stimulation treatment and all natural well pressure is lost, or a well having no natural pressure must be stimulated. In the event that a well has no natural pressure, a cable hooked to an eye in a top end of the pull rod may be used to stroke the mandrel out of the well. Under normal conditions, natural well pressure is used to stroke the mandrel out of the well.

In accordance with another preferred embodiment of the invention, there is provided a well head isolation tool equipped with a mechanical screw for stroking the mandrel into or out of a well. The mechanical screw is preferably a worm gear ball screw which provides excellent mechanical advantage. The mechanical screw is conveniently driven by a hydraulic motor, although other drive mechanisms are acceptable. The mechanical screw has the advantage of minimizing the hydraulic power requirements for the equipment used to stroke the mandrel into or out of the well. To isolate a wellhead of a well with a very high natural pressure, say 10,000 psi or more, high performance hydraulic equipment is required to set the tool in accordance with the first embodiment of the invention. It is not necessarily practical to provide an entire fleet of tools with high performance hydraulics. It is therefore more practical to provide a tool equipped with a mechanical screw for use in isolating wellheads on wells with extreme natural pressure. It is also practical to use this tool for wells with normal natural pressure or with no natural pressure at all.

In accordance with yet another preferred embodiment of the invention, there is provided a well head isolation tool equipped with a mechanical screw and a pack-off nipple expander for ensuring that the pack-off nipple is in sealing contact with the production tubing or well casing. This permits the use of a pack-off nipple that is more readily inserted through the well tree and into the production casing or the well tubing, while providing a reliable sealing engagement with the production tubing or the well casing after the mandrel is stroked into the well. The pack-off nipple expander is carried on an inner mandrel attached to a rod that extends through an axial bore in the mechanical screw. The inner mandrel is slidingly received in an outer mandrel that carries an elastomeric pack-off nipple. The pack-off nipple expander attached to the bottom end of the inner mandrel is typically frusto conical in shape.

BRIEF DESCRIPTION OF THE DRAWINGS

The invention will now be further explained by way of example only and with reference to the following drawings, wherein.

DETAILED DESCRIPTION OF THE PREFERRED EMBODIMENT

Figure 1:
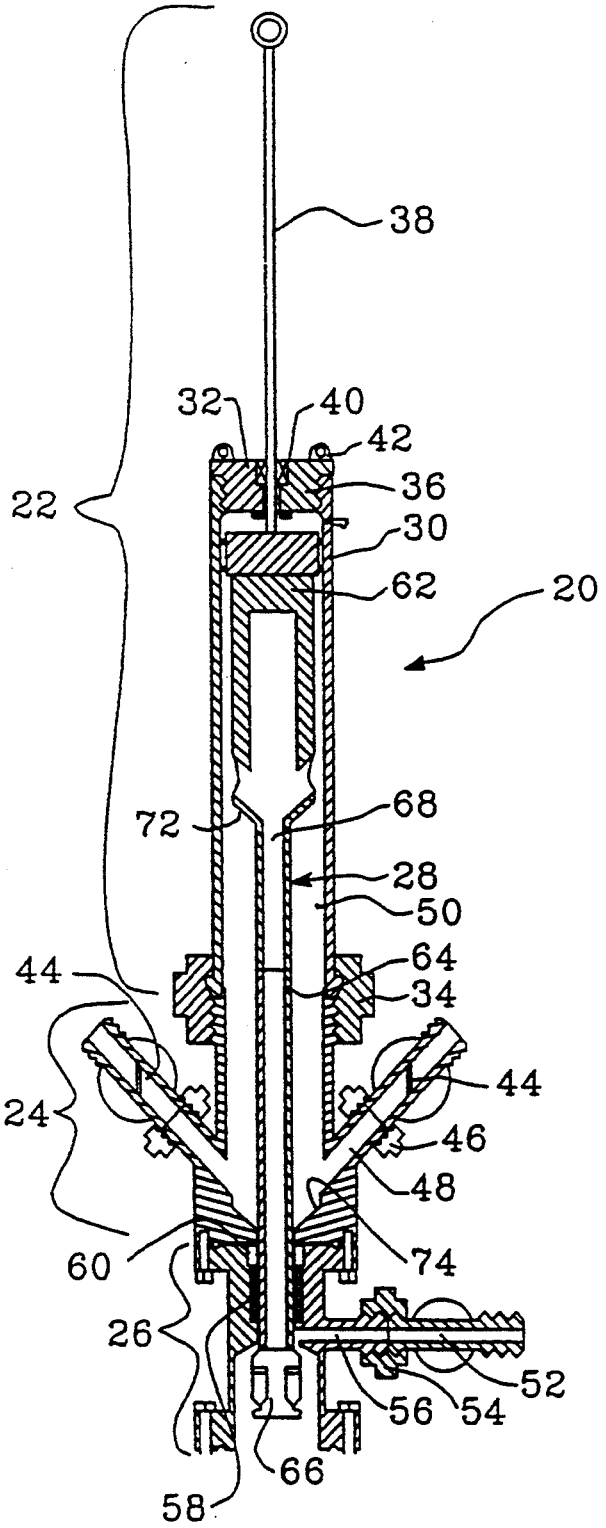
FIG. 1 is a longitudinal cross-sectional view of a wellhead isolation tool in accordance with the invention.

FIG. 1 shows a wellhead isolation tool in accordance with the invention, generally referred to by reference 20. The wellhead isolation tool 20 includes a mandrel positioning assembly 22, a high pressure valve assembly 24, a pressure relief valve assembly 26 and a mandrel assembly generally referred to by reference 28. The mandrel positioning assembly 22 includes a hollow cylinder 30 having a closed top end 32 and an open bottom end which may be connected by means of a hammer union 34 to the high pressure valve assembly 24. The cylinder further includes a piston 36 constructed in a manner well known in the art. The piston 36 is forcibly reciprocatable within the cylinder 30. Attached to a top side of the cylinder 36 is a pull rod 38 which is preferably provided but not a mandatory component of the tool. The function of the pull rod 38 will be explained hereinafter in detail. Pull rod 38 passes through the closed top end 32 of the cylinder 30. A fluid seal 40, commonly known in the art, prevents the egression of hydraulic fluid from the cylinder while permitting reciprocal movement of the pull rod 38. A pair of hook eyes 42 are also preferably provided in the closed top end 32 of the cylinder. The hook eyes provide a hook up for a cable harness used to hoist the wellhead isolation tool 20 to and from a derrick truck and onto a wellhead. The cable harness (not illustrated) preferably includes a spreader to prevent contact of the cable with the pull rod 38 while the wellhead isolation tool 20 is being moved. Cable harnesses of this type are well known in the art. Chain, rope or other attachments may also be used to move the tool to a working location. The closed top end 32 of the cylinder is preferably closed by a cap which threadedly engages the side walls of the cylinder 30 in a manner well known in the art. This permits access to an interior of the cylinder so that repairs or maintenance of the piston and/or the push rod may be effected.

The high pressure valve assembly 24 preferably includes at least one high pressure valve 44. Two or more high pressure valves 44 may be provided. Each high pressure valve 44 is connected by a hammer union 46 to a high pressure bore 48 that communicates with a sealed bore 50 defined by the tool.

The pressure relief valve assembly 26 includes a pressure relief valve 52 which is connected by a hammer union 54 to a pressure relief bore 56 that communicates with the sealed bore 50. The pressure relief assembly 26 also includes a plurality of packing rings 58 that surrounds a periphery of a lower end of the mandrel assembly 28 to provide a fluid seal between the pressure relief valve 52 and the high pressure valves 44. The packing rings 58 are retained in position by a packing nut 60.

The mandrel assembly 28 includes an injection head 62, the construction of which will be described in more detail with reference to FIG. 1A, and a mandrel 64 which preferably threadedly engages a lower end of the injection head 62. Attached to a bottom end of mandrel 64 is a pack-off nipple assembly 66, well known in the art. A variety of pack-off nipple assemblies in a range of sizes are commonly available. The pack-off nipple assembly 66 is used to form a fluid-tight connection of the mandrel 64 with a well casing or tubing (not illustrated in this figure) in a well to be treated. The mandrel assembly 28 is affixed to piston 36. The connection of the mandrel assembly 28 and the piston 36 is preferably made with screw or bolt fasteners (not illustrated) in a manner well known in the art. The mandrel assembly 28 is therefore forcibly reciprocatable in the sealed bore. 50 with the piston 36. The movement and control of the piston 36 will be explained in detail with reference to FIGS. 2 through 5.

Figure 1A:
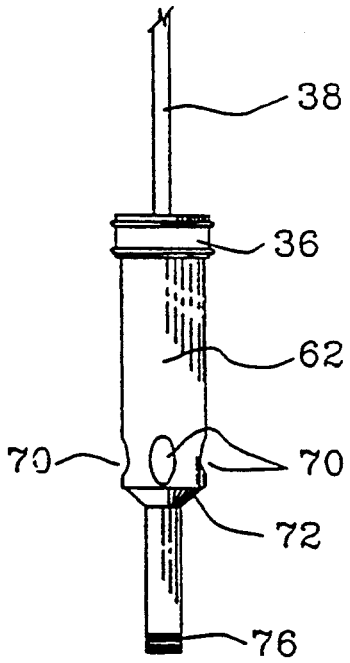
FIG. 1A is a side elevational view of a mandrel injection head in accordance with the invention.

FIG. 1A shows a detailed elevational view of a preferred construction for the injection head assembly 62. The injection head 62 includes an axial bore 68 (see FIG. 1) and at least one injection port 70 for each high pressure bore 48 (see FIG. 1 ). The injection head 62 also has a tapered shoulder 72 which abuts a complementary region 74 (see FIG. 1 ) in the sealed bore 50 when the mandrel assembly 28 is extended through a wellhead and the pack-off nipple assembly 66 is sealingly engaged with the well tubing or casing. This ensures that the injection ports 70 align with the high pressure bores 48 to permit stimulation fluid to be pumped through the high pressure bores 48 and the mandrel 64 into the well bore. The high pressure bores 48 are preferably inclined at an angle of about 40°–50° with respect to the sealed bore 50. The angle of inclination is not critical. The inclination of the high pressure bores 48 reduces backwash of abrasive laden fluids and thereby extends the service life of the injection head 62. An injection head 62 will eventually erode to a point that it must be replaced if large volumes of abrasive fluids are pumped for extended periods of time. The injection head is therefore preferably affixed to piston 36 with screw or bolt fasteners, as noted above, and the lower end of the injection head 62 preferably includes a threaded joint 76 to which the mandrel 64 is attached, permitting the injection head 62 and/or mandrel 64 to be replaced as required.

Figure 2:
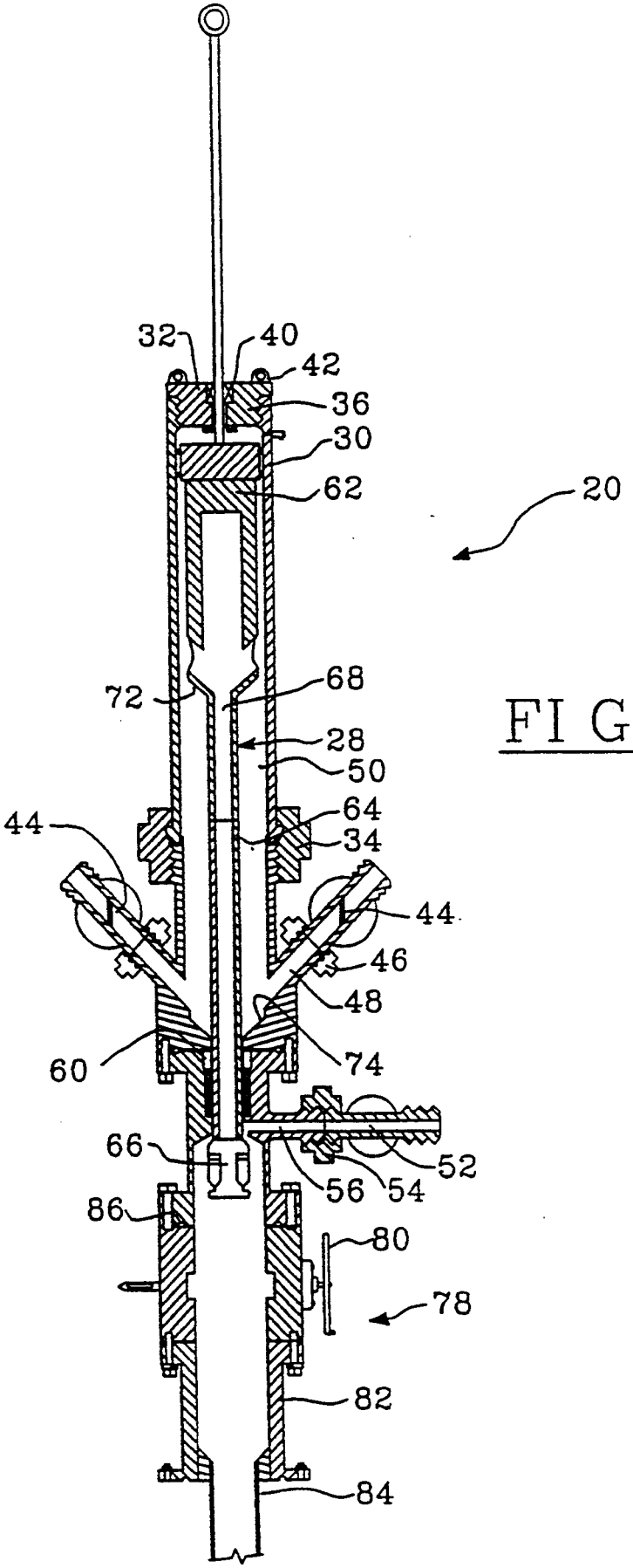
FIG. 2 is an elevational cross-section of the wellhead isolation tool shown in FIG. 1 mounted on a wellhead.

FIG. 2 shows a wellhead isolation tool 20 in accordance with the invention installed on a wellhead generally indicated by reference 78. The wellhead 78 includes at least a master valve 80, a tubing spool 82 and a production tubing 84. Other well components which make up the wellhead such as ball valves, blow-out prevention stacks, drilling spools, tubing bonnets, casing spools, casing bowls and related flanges in various combinations are not illustrated. When a well is to be stimulated, the master valve 80 is closed and a wellhead cap (not illustrated) is removed from a top of the wellhead and the wellhead isolation tool 20 is bolted to the wellhead. An 0-ring 86 or similar sealing device ensures a pressure tight seal of the tool to the wellhead. After the wellhead isolation tool 20 is bolted to the wellhead, the master valve 80 is opened to permit the mandrel assembly 28 to be stroked through the wellhead. The mandrel assembly 28 is stroked downwards by introducing pressurized fluid through a hydraulic valve 88 located at a top of the cylinder 30 just beneath the closed top end 32 of the cylinder. The pressurized fluid may be a hydraulic fluid supplied by a hydraulic line (not illustrated). Alternatively, well gases may be used to set the mandrel assembly 28 if the wellhead has a high natural pressure. This can be accomplished by connecting a high pressure hose between the pressure relief valve 52 and the hydraulic valve 88. The introduction of pressurized fluid through the hydraulic valve 88 forces the piston 32 and the mandrel assembly 38 downwards through the wellhead 78. The pull rod 38 provides a position gage which indicates the travel of the mandrel assembly 28. This can be very helpful in setting a mandrel assembly since an operator of the wellhead isolation tool 20 is always certain of the exact position of the mandrel within the wellhead. Pressurized fluid is injected through the hydraulic valve 88 until the mandrel assembly 28 is completely seated and the pack-off nipple assembly 66 sealingly engages the well robe 84, as shown in FIG. 3.

Once the mandrel is fully seated the fluid pressure above the piston 36 is preferably increased to a pressure which exceeds the maximum pump pressure of the well stimulation treatment. This locks the cylinder 36 and the mandrel assembly 28 in the service position shown in FIG. 3. When the mandrel assembly 28 is properly seated, the pack-off nipple assembly 66 sealingly engages the well robe or well casing 84 and only the hook eye 92 at the top end of the pull rod 38 is visible above the closed top end 32 of cylinder 30. In this position, the injection ports 70 (see FIG. 1A) in injection head 62 align with the high pressure bores 48 which connect the high pressure valves 44 with the sealed bore 50, Well stimulation lines can then be connected to the free ends of the high pressure valves 44 to begin a well stimulation treatment. Fluid pumped through one or more of the high pressure valves 44 passes through the high pressure bores 48 and the injection head 62. The fluid then passes through an axial bore 68 in the mandrel 64 and subsequently into the well bore.

Figure 3:
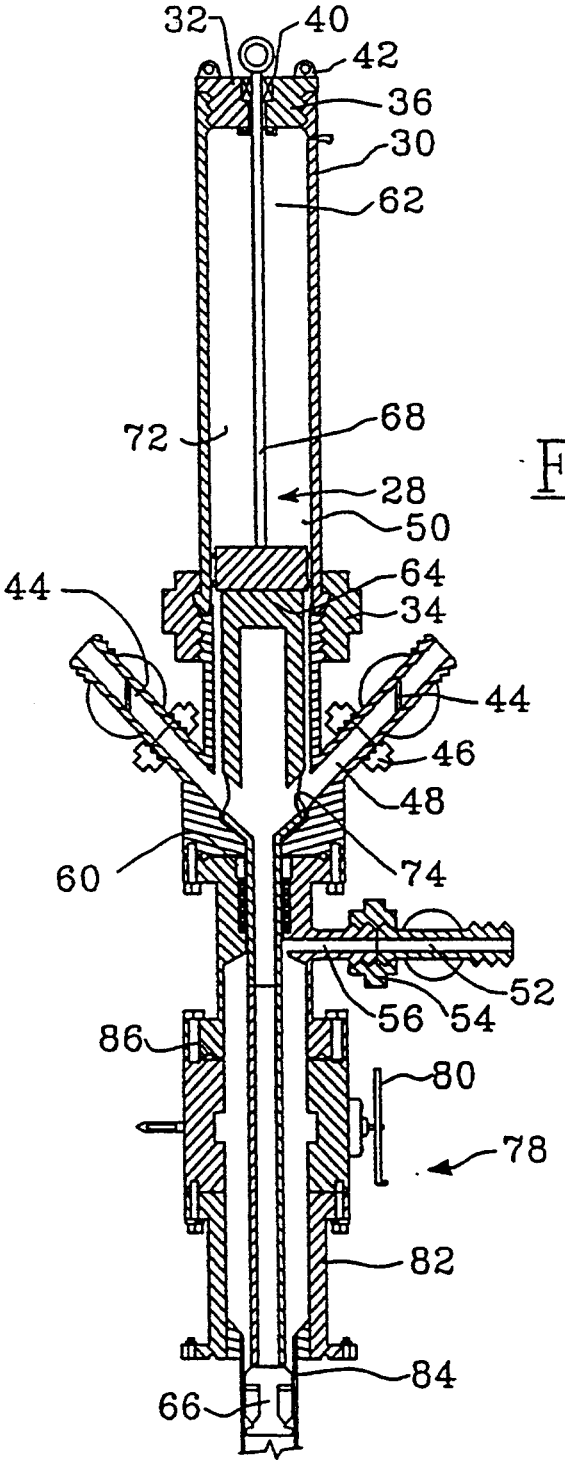
FIG. 3 is an elevational cross-section of the wellhead isolation tool shown in FIG. 2 with the mandrel extended through the wellhead and the pack-off nipple assembly sealingly engaged in the production tubing of the well.

As is apparent from FIG. 3, the mandrel assembly is maintained in the well by the overburden of fluid pressure introduced through valve 88. The mandrel assembly can therefore be extracted from the wellhead by releasing fluid pressure from valve 88. Normally, the fluid pressure to valve 88 is supplied by a hydraulic line which is connected to a hydraulic pump that is located a safe distance from the wellhead. In a case of emergency this arrangement permits the mandrel assembly 28 to be stroked out of the wellhead by operating a relief valve at the pump, thus obviating any requirement to approach the wellhead. When fluid is relieved through valve 88, the well pressure exerted on the injection head 62 strokes the mandrel from the well. A blowout preventer (not illustrated) can then be forced closed by a remote hydraulic control, or similar safety equipment can be operated without approaching the wellhead. Thus, the danger of loss of control of a wellhead due to an equipment failure is minimized and the risk of personal injury for personnel servicing the wellhead is reduced.

After the mandrel assembly 28 is seated in a position ready to begin a well stimulation treatment as shown in FIG. 3, the pressure relief valve 52 is opened to ensure that the pack-off nipple assembly 66 is effectively sealed in the well robing or casing 84. If any pressure escapes from pressure relief valve 52, the pack-off nipple assembly 66 is damaged and the tool must be removed from the wellhead for repairs. If no pressure escapes from pressure relief valve 52, the well treatment pumps are tested against the closed high pressure valves 44 to ensure that the well treatment lines are intact and in a condition to begin the well treatment. High pressure valves 44 are then opened and well stimulation treatment begun. The packing 58 located between the high pressure valves 44 and the pressure relief valve 52 ensures that no well stimulation fluids migrate into the wellhead during the stimulation treatment. The pressure relief valve 52 is preferably left in a partially opened condition during a stimulation treatment so that pressure in the wellhead can be monitored to ensure that a failure of the mandrel 64 or the pack off nipple assembly 66 is detected. An 0-ring 86 located at a top of the high pressure valve assembly 24 ensures that no well stimulation fluids migrate into cylinder 30 where they could foul the cylinder and interfere with the reciprocal movement of the piston 36.

Figure 4:
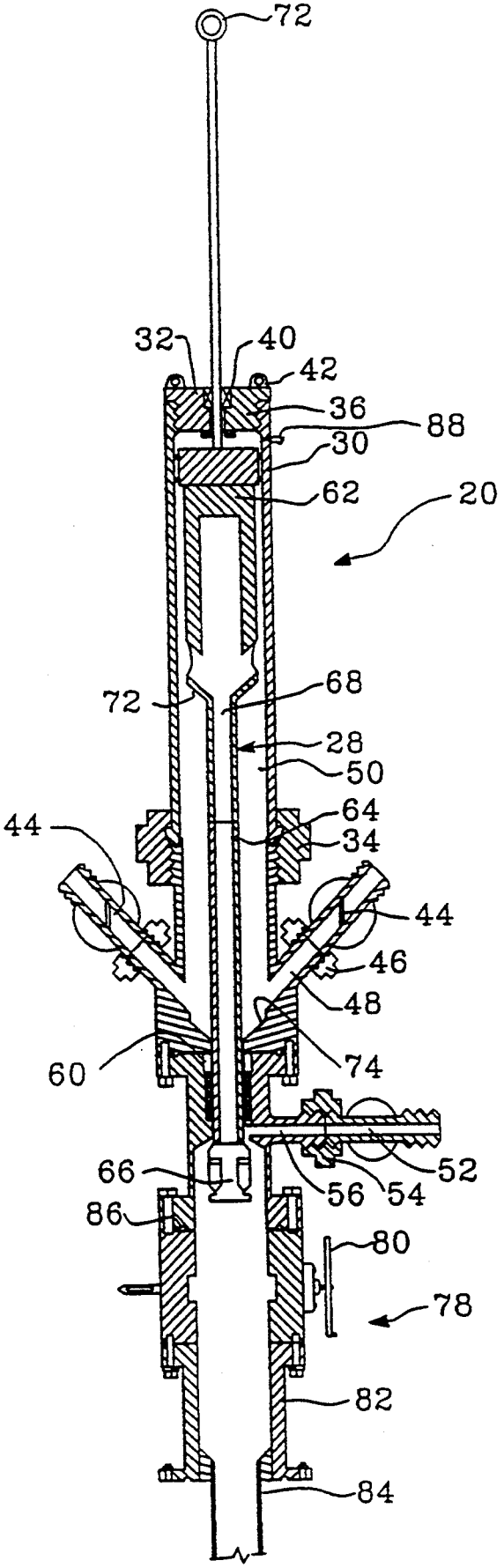
FIG. 4 is an elevational cross-section of the wellhead isolation tool shown in FIG. 1 with the mandrel extracted from the wellhead after a stimulation treatment.

After a well stimulation treatment is complete, hydraulic pressure is relieved through valve 88 to permit the well pressure exerted on the injection head 62 to force the piston 36 and the mandrel assembly 28 upwards until the mandrel 64 is stroked out of the wellhead, as shown in FIG. 4. Under normal operating conditions, it is preferable to equalize the pressure on the wellhead with the pressure in the well before the pack-off nipple assembly 66 is extracted from the production tubing 84 so that the wellhead 78 is not subjected to a sudden pressure surge when the mandrel 64 is stroked out of the wellhead. This is accomplished by connecting opposite ends of a high pressure hose (not illustrated) to one of the high pressure valves 34 and the pressure relief valve 52, respectively. The two valves are opened to permit an equalization of the pressure and closed to maintain the equalized pressure before the mandrel 64 is stroked out of the wellhead 78. In an emergency situation this procedure can be bypassed.

In the event that a well has no natural pressure or the well is killed during a stimulation treatment, a cable harness or the like (not illustrated) may be attached to the hook eye 92 at the top end of the pull rod 38, and the mandrel maybe extracted using a derrick or a crane. When the mandrel is extracted using a derrick or a crane, valve 88 must be in the full open position in order to permit the escape of pressurized fluid from the space above the piston 36. The pull rod 38 also ensures that the mandrel 64 can be extracted from the wellhead even in the event of severe screen out when the entire well stimulation apparatus is plugged with abrasives packed under extreme pressure. This provides a distinct advantage over the prior art since it permits the extraction of the mandrel 64 from the wellhead under any anticipated circumstance, even if the high pressure valves 44 cannot be closed and the well stimulation lines (not illustrated) cannot be disconnected from the high pressure vales 44.

In case of an emergency, it is not necessary to disconnect the stimulation lines, close the high pressure valves or make any other preparations prior to stroking the mandrel 64 out of the wellhead. The only requirement is to stop the stimulation pump(s) prior to evacuating pressurized fluid through valve 88 to stroke the mandrel 64 out of the wellhead. Emergency equipment such as blow-out preventers or master valves can then be operated directly or remotely to close off the well and prevent disaster. Once the situation is under control, stimulation lines can be disconnected and the tool can be removed from the wellhead for cleaning or maintenance.

Figure 5:
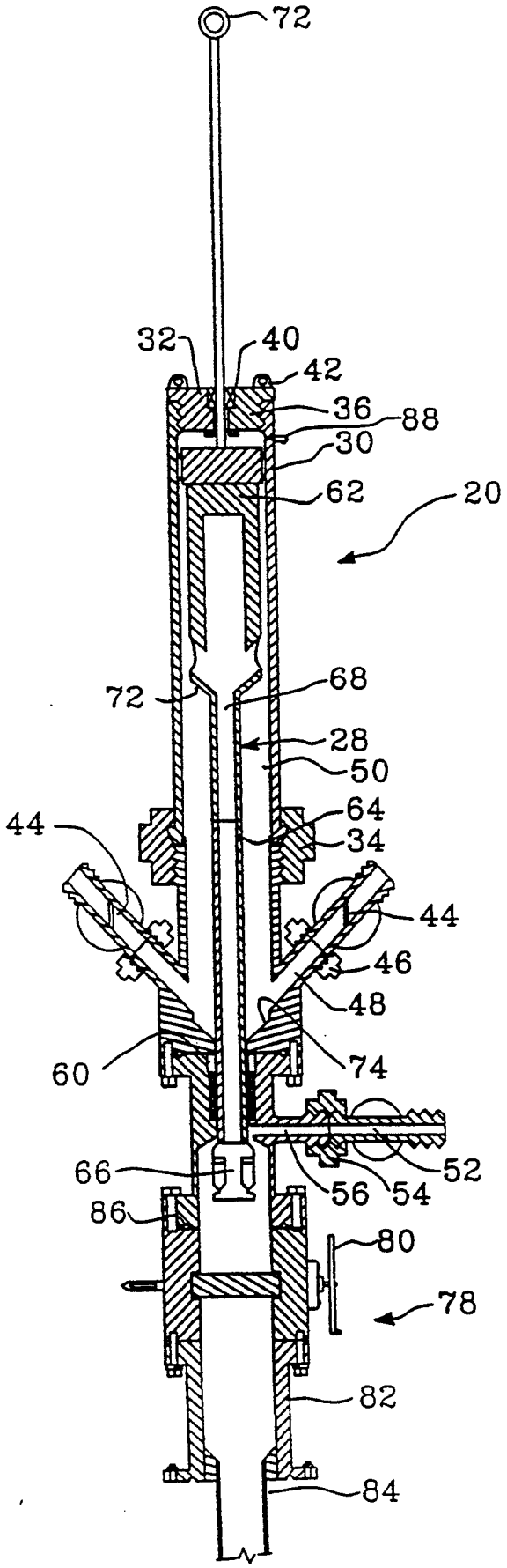
FIG. 5 is a elevational cross-section of the wellhead isolation tool on the wellhead shown in FIG. 2 with the master valve of the wellhead closed so that the wellhead isolation tool can be removed after a well stimulation operation.

As shown in FIG. 5, after the mandrel 64 is extracted from the wellhead the master valve 80 is closed and the wellhead isolation tool 20 is removed from the wellhead. Once the mandrel 64 is in the fully raised position the master valve 80 is closed and pressure above the master valve is bled off through the pressure relief valve 52. The wellhead isolation tool 20 is then removed from the wellhead 78 and normal well production is resumed.

Figure 6:
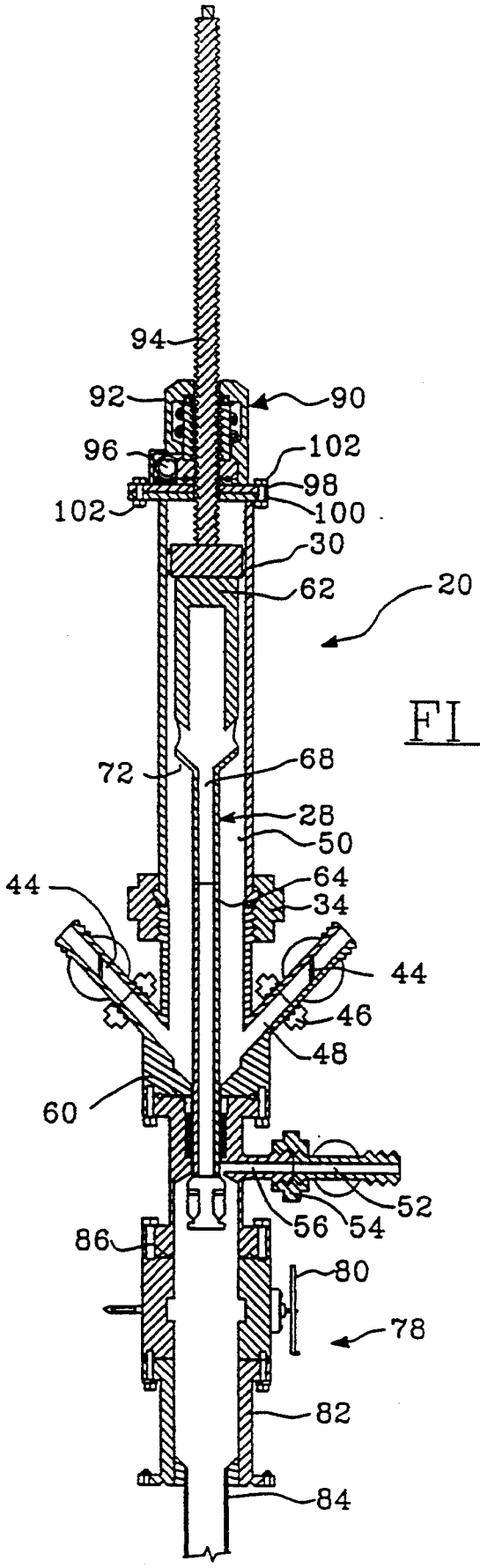
FIG. 6 is a longitudinal cross-sectional view of a second preferred embodiment of a wellhead isolation tool in accordance with the invention.

FIG. 6 shows another preferred embodiment of the invention particularly useful for treating wells having unusually high natural pressure or wells having no natural pressure at all. In this embodiment, the tool is stroked into and out of the wellhead using a mechanical screw which is preferably a worm gear driven ball screw commercially available from Limitorque of Lynchburg, Va., U.S.A.

The worm gear driven ball screw, generally indicated by reference 90, includes a drive unit 92 and a lifting screw 94, respectively constructed in accordance with principles well known in the art. A drive shaft 96 may be powered by a hydraulic motor, an electric motor, or, in emergencies, by a hand crank or the like. Rotational movement of the drive shaft 96 translates to axial movement of the lifting screw 94. The lifting screw 94 moves axially through the drive unit 92 but does not rotate about its axis. The drive unit 92 has a base plate 98 which is affixed to a top plate 100 of the cylinder 30 using bolts 102, or the like. The cylinder 30 is preferably constructed from 15,000 psi hydraulic cylinder tube to withstand the elevated pressures of well stimulation processes. The top plate 100 is preferably welded to a top end of the cylinder 30.

In all other respects, this embodiment of the invention is identical to the embodiment shown in FIGS. 1–5. Operation of the unit is likewise identical with the exception that a hydraulic motor (not illustrated), or the like, drives the ball screw downwards to stroke the mandrel through the well head, and vice-versa. The drive shaft 96 can be driven using a hydraulic motor that operates at a maximum of 1,800 psi, regardless of the natural pressure in a well being treated. Thus, wells having very high natural pressure can be serviced without providing high performance hydraulic equipment for stroking the mandrel 64 into the well. In addition, the ball screw 90 can be locked in any position even in the event that hydraulic pressure to the drive motor (not illustrated) is lost due to a mechanical malfunction or a hydraulic seal rupture. This ensures that a mandrel cannot be ejected from a well during a well stimulation operation. This embodiment of the invention permits the mandrel to be stroked out of a well having no natural pressure without resort to a derrick or crane, since the ball screw operates independently of the pressure in the well.

Figure 7:
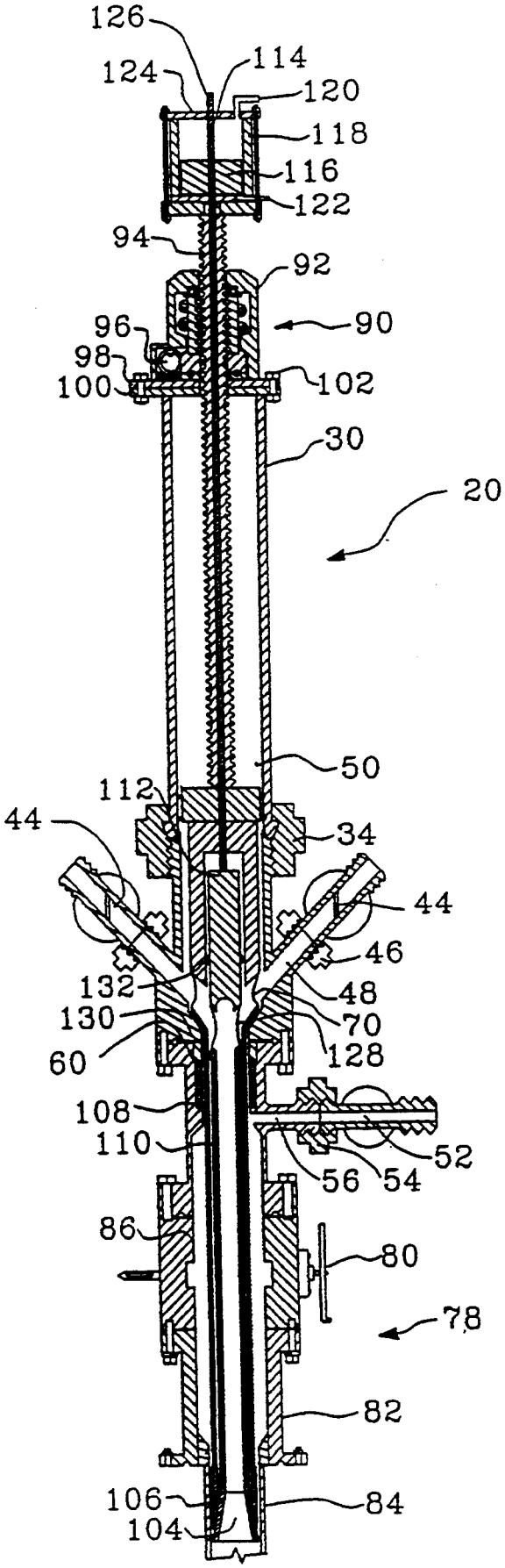
FIG. 7 is a longitudinal cross-sectional view of the wellhead isolation tool shown in FIG. 6, adapted to accommodate a pack-off nipple expander using concentric mandrels, the tool being shown in an installed condition on the wellhead wherein the pack-off nipple has been lowered into the well tubing but not yet expanded to effect a secure seal with the well tubing.

FIG. 7 shows a further embodiment of the invention wherein the wellhead isolation tool shown in FIG. 6 is provided with a pack-off nipple expander 104 to help ensure a positive seal of an elastomeric pack-off nipple 106 with the production tubing 84 of the well. The wellhead isolation tool 20 shown in FIG. 7 has been mounted to the wellhead 78 and stroked downward into the production tubing 84. The pack-off nipple expander 104 is shown in a position used to stroke the tool through the wellhead wherein the elastomeric pack-off nipple 106 is in an unexpanded condition above the pack-off nipple expander 104. The elastomeric pack-off nipple 106 is attached to a free end of an outer mandrel 108 which is similar in shape to the mandrel 64 shown in FIGS. 1–5. Slidable within the outer mandrel 108 is an inner mandrel 110 having the pack-off nipple expander 104 affixed to its lower end. The chamber inside the injection head 62 houses an inner mandrel injector 112 that is mounted to a control rod 114. The control rod 114 is slidable in an axial bore that pierces the lifting screw 94. The control rod 114 extends through a bore that pierces a piston 116 in a hydraulic cylinder 118 mounted to a top end of the lifting screw 94. The hydraulic cylinder 118 is provided with hydraulic ports 120 and 122 for controlling a position of the piston 116 in the cylinder 118. The control rod 114 preferably extends through a top end wall 124 of the hydraulic cylinder 118 to provide a graphic indication of the position of the inner mandrel injector 112 with respect to the injection head 62. The control rod 114 is also preferably provided with an external thread 126 to permit the attachment of a lifting eye, or the like, to facilitate manipulation of the wellhead isolation tool 20. In all other aspects of construction and operation, this embodiment of the wellhead isolation tool is identical to the embodiments described in FIGS. 1–6.

Figure 8:
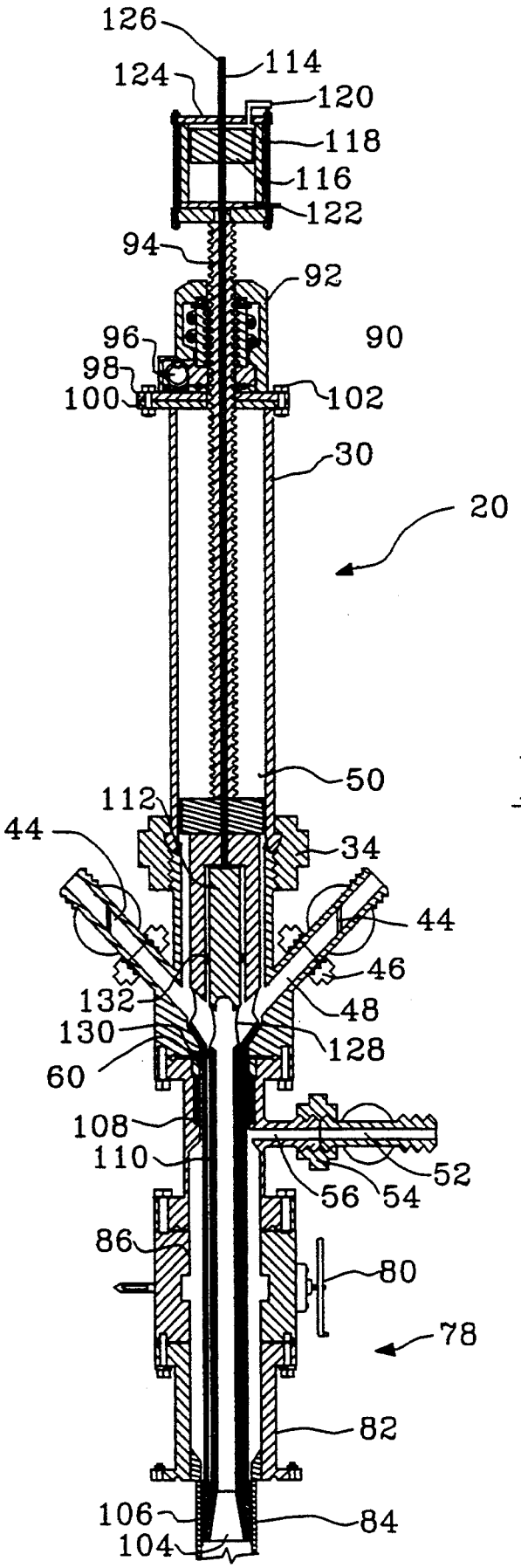
FIG. 8 is an elevational cross-section of the embodiment of the invention shown in FIG. 7, with the pack-off nipple in an operative position, the wellhead isolation tool being ready for a well stimulation procedure.

FIG. 8 shows the wellhead isolation tool shown in FIG. 7 in an operational condition wherein the pack-off nipple expander 104 is drawn upward by the hydraulic cylinder 118 into its operational position. The elastomeric pack-off nipple 106 is expanded into sealing relation with the production robing 84 and injection ports 128 in the inner mandrel injector 112 are aligned with injection ports 70 (see FIG. 7) in the injector head 62.

A high pressure 0-ring 130 effects a seal between the inner and outer mandrels to prevent abrasives injected into the well from infiltrating between the inner and outer mandrels and interfering with the reciprocal movement of the inner mandrel 110 in the outer mandrel 108. A high pressure seal 132 likewise provides a seal between the injection ports 70 (see FIG. 7) and the axial bores that accommodate the inner mandrel injector 112 and the control rod 114. Therefore, when well stimulation fluids are pumped through high pressure bores 48, the stimulation fluids are routed into and contained within the inner mandrel where they are forced through an orifice in the pack-off nipple expander 104 and, consequently, into the well.

After a well stimulation operation is complete, the piston 116 in the hydraulic cylinder 118 is forced downwardly by the injection of pressurized hydraulic fluid into hydraulic port 120 and the evacuation of hydraulic fluid from hydraulic port 122. This moves control rod 114 and the inner mandrel injector 112 downwardly to disengage the pack-off nipple expander 104 from the pack-off nipple 106 as shown in FIG. 7. The elastomeric pack-off nipple 106 retracts from the production robing 84 and the ball screw drive unit 92 is operated to stroke the concentric mandrels 108 and 110 out of the well in unison.

It is apparent from the foregoing that a new and useful wellhead isolation tools which provide significant advantages over the prior art have been invented. Changes and modifications to the specific embodiments described above may become apparent to those skilled in the art. The preferred embodiments described above are intended to be exemplary only and the principles and concepts disclosed are not intended to be limited thereby.

We claim:

1. A wellhead isolation tool to permit the injection of fluids, solid particles or mixtures thereof through a wellhead having a vertical passage therethrough and including at least one valve and into a well having a production tubing or well casing aligned with the vertical passage, the wellhead isolation tool comprising:

means for attaching the tool to the wellhead;

a pressure relief valve located adjacent the means for attaching the tool to the wellhead;

a high pressure valve located above the pressure relief valve; a hollow cylinder located above the high pressure valve, the cylinder having a piston forcibly reciprocatable therein and the piston having a top end and a bottom end;

a mechanical screw affixed to the top end of the piston for forcibly reciprocating the piston in the hollow cylinder;

a mandrel affixed to a bottom end of the piston and reciprocatable with the piston in a sealed bore defined by the tool, the mandrel including an axial bore and an injection port which communicates with the axial bore so that the injection port aligns with a high pressure bore selectively closed by the high pressure valve when the mandrel extends through the wellhead and a pack-off nipple attached to a bottom end of the mandrel sealingly engages the production tubing or the casing; and packing means for engaging a periphery of the mandrel in a fluid tight seal which permits reciprocal movement of the mandrel, the packing means being located between the pressure relief valve and the high pressure valve.

2. The wellhead isolation tool as claimed in claim 1 wherein the mechanical screw comprises a worm gear driven ball screw.

3. The wellhead isolation tool as claimed in claim 2 wherein the drive unit for the worm gear driven ball screw is mounted to a plate affixed to a top end of the hollow cylinder.

4. The wellhead isolation tool as claimed in claim 1 wherein the wellhead isolation tool includes two or more high pressure valves which selectively close respective high pressure bores that communicate with respective injection ports in the mandrel.

5. A wellhead isolation tool to permit the injection of fluids, solid particles or mixtures thereof into a wellhead having a vertical passage therethrough including at least one valve and into a well having a production tubing or a well casing aligned with the vertical passage, the wellhead isolation tool comprising:

a mandrel positioning assembly which includes a hollow cylinder having a top end and an open bottom end that is adapted for fluid tight connection with a top end of a high pressure valve assembly, a piston which is forcibly reciprocatable within the cylinder, a mechanical screw attached to a top side of the piston, the mechanical screw being adapted to forcibly reciprocate the piston within the cylinder;

the high pressure valve assembly including at least one high pressure valve for selectively closing at least one high pressure bore which communicates with a sealed bore defined by the tool and having a bottom end adapted for a fluid tight connection with a top end of a pressure relief valve assembly;

the pressure relief valve assembly including at least one valve for selectively closing at least one bore which communicates with the central passage defined by the tool, and a bottom end adapted for fluid-tight connection with a top end of the wellhead;

packing means for engaging a periphery of a mandrel portion of a mandrel assembly in a fluid tight seal which permits reciprocal movement of the mandrel, the packing means being located between the high pressure valve and the pressure relief valve in the sealed bore defined by the tool;

the mandrel assembly including an injection head affixable to a bottom side of the piston, the mandrel being connected to the injection head, and a pack-off nipple assembly connected to a bottom end of the mandrel, the injection head including at least one injection port in fluid communication with an axial bore through the mandrel and the pack-off nipple assembly, whereby the at least one injection port is located in the injection head so that the injection port is in fluid communication with the high pressure bore when the mandrel is extended through the wellhead and the pack-off nipple assembly sealingly engages the well tubing or casing.

6. The wellhead isolation tool as claimed in claim 5 wherein the packing means comprises a plurality of packing rings retained in the top end of the pressure relief valve assembly by a packing nut.

7. The wellhead isolation tool as claimed in claim 5 wherein the mechanical screw is a worm gear driven ball screw.

8. The wellhead isolation tool as claimed in claim 7 wherein a drive unit for driving the ball screw is attached to a plate affixed to a top of the cylinder.

9. A wellhead isolation tool to permit the injection of fluids, solid particles or mixtures thereof into a wellhead having a vertical passage therethrough including at least one valve and into a well having a production tubing or a well casing aligned with the vertical passage, the wellhead isolation tool comprising:

a mandrel positioning assembly which includes a hollow cylinder having a top end and an open bottom end that is adapted for fluid tight connection with a top end of a high pressure valve assembly, a piston which is forcibly reciprocatable within the cylinder, a mechanical screw attached to a top end of the piston, the mechanical screw being adapted to forcibly reciprocate the piston within the cylinder;

the high pressure valve assembly including at least one high pressure valve for selectively closing at least one high pressure bore which communicates with a sealed bore defined by the tool and having a bottom end adapted for a fluid tight connection with a top end of a pressure relief valve assembly;

the pressure relief valve assembly including at least one valve for selectively closing at least one bore which communicates with the central passage defined by the tool, and a bottom end adapted for fluid-tight connection with a top end of the wellhead;

packing means for engaging a periphery of a mandrel portion of a mandrel assembly in a fluid tight seal which permits reciprocal movement of the mandrel, the packing means being located between the high pressure valve and the pressure relief valve in the sealed bore defined by the tool;

the mandrel assembly including an injection head affixable to a bottom side of the piston, an outer mandrel connected to the injection head, a concentric inner mandrel reciprocatable within the outer mandrel, the inner mandrel being in connection with a control rod that extends through an axial bore in the injection head, the piston and the mechanical screw, an elastomeric pack-off nipple connected to a bottom end of the outer mandrel and a pack-off nipple expander connected to a bottom end of the inner mandrel, the injection head and the inner mandrel respectively including at least one injection port in fluid communication with an axial bore through the inner mandrel and the pack-off nipple expander; and the at least one injection port for establishing fluid communication with the axial bore in inner mandrel so located that respective injection ports are in fluid communication with corresponding high pressure bores when the concentric mandrels are extended through the wellhead and the pack-off nipple expander has expanded the elastomeric pack-off nipple so that it sealingly engages the well tubing or casing.

10. A well head isolation tool as claimed in claim 9 wherein the control rod and the inner mandrel are displaced by a hydraulic cylinder mounted to a top end of the mechanical screw.

11. A well head isolation tool as claimed in claim 10 wherein the control rod extends through a top end wall of the hydraulic cylinder to provide a graphic indication of the position of the inner mandrel with respect to the outer mandrel.

12. A method of isolating a wellhead located on an oil or gas well from the effects of high pressure or corrosion due to a stimulation treatment of the well, comprising the steps of:

a) connecting to the wellhead an isolation tool which includes a high pressure valve that selectively closes a high pressure bore which communicates with a sealed bore defined by the tool, and a hollow mandrel having no direct connection with the high pressure bore, the mandrel being forcibly reciprocatable in the sealed bore and including an injection port which aligns with the high pressure bore when the mandrel is stroked into the wellhead, and a mechanical screw for forcibly stroking the mandrel into the wellhead;

b) opening a valve in the wellhead to open a vertical passage through the wellhead, and operating the mechanical screw to forcibly stroke the mandrel through the wellhead until a pack-off nipple assembly connected to a bottom end of the mandrel sealingly engages a production tubing or well casing of the well and the injection port of the mandrel aligns with the high pressure bore;

c) connecting a high pressure line to the high pressure valve and pumping well stimulation fluids into the well;

d) closing the high pressure valve and disconnecting the high pressure lines;

e) reversing the mechanical screw to withdraw the mandrel from the wellhead; and f) closing the valve in the wellhead and removing the tool from the wellhead.

13. The method as claimed in claim 12 further comprising the step of equalizing the pressure in the wellhead with the pressure in the wellbore before stroking the mandrel out of the wellhead by connecting a high pressure hose between the high pressure valve and a pressure relief valve which selectively closes a bore that communicates with the vertical passage in the wellhead, opening the respective valves to equalize the pressure and closing the respective valves to maintain the equalized pressure while the mandrel is stroked out of the wellhead so that the wellhead is not subjected to a high pressure surge when the pack-off nipple loses its sealing engagement with the production tubing or the casing.

14. The method as claimed in claim 13 wherein, in the case of an emergency, the mandrel is stroked out of the wellhead as soon as the high pressure pumps can be stopped without closing the high pressure valves or disconnecting the high pressure line, so that a blow-out prevention stack or a well valve may be operated to close off the wellhead and bring the well under control without delay.

15. The method as claimed in claim 12 wherein the mandrel includes concentric inner and outer mandrels, the outer mandrel having a free end which includes an elastomeric pack-off nipple and the inner mandrel having a free end which includes a pack-off nipple expander and the method further includes the step of displacing the inner mandrel upwardly within the outer mandrel after the mechanical screw has been operated to stroke the mandrel through the wellhead in order to expand the elastomeric pack-off nipple to ensure sealing contact with the production tubing or well casing; and the method further includes the step of displacing the inner mandrel downwardly within the outer mandrel to release the sealing contact of the elastomeric pack-off nipple with the well tubing or casing before the mandrel is stroked out of the well.

* * * * *